US006486605B1

(12) United States Patent
Beunas et al.

(10) Patent No.: US 6,486,605 B1
(45) Date of Patent: Nov. 26, 2002

(54) MULTIBEAM ELECTRONIC TUBE WITH MAGNETIC FIELD FOR CORRECTING BEAM TRAJECTORY

(75) Inventors: Armel Beunas, Boulogne Billancourt (FR); Georges Faillon, Meudon (FR)

(73) Assignee: Thomson Tubes Electroniques, Meudon La Foret (FR)

( * ) Notice: Subject to any disclaimer, the term of this patent is extended or adjusted under 35 U.S.C. 154(b) by 0 days.

(21) Appl. No.: 09/720,811

(22) PCT Filed: Jul. 2, 1999

(86) PCT No.: PCT/FR99/01595

§ 371 (c)(1),
(2), (4) Date: Jan. 3, 2001

(87) PCT Pub. No.: WO00/02226

PCT Pub. Date: Jan. 13, 2000

(30) Foreign Application Priority Data

Jul. 3, 1998 (FR) ..... 98 08552

(51) Int. Cl.[7] ..... H01J 23/08
(52) U.S. Cl. ..... 315/5.35; 315/5
(58) Field of Search ..... 315/5.35, 4, 5, 315/5.16, 5.33, 5.38, 5.39; 313/409

(56) References Cited

U.S. PATENT DOCUMENTS

| | | | | |
|---|---|---|---|---|
| 3,775,635 A | | 11/1973 | Faillon et al. | 315/5.43 |
| 3,846,665 A | | 11/1974 | Firmain et al. | 315/5.43 |
| 4,173,744 A | | 11/1979 | Faillon et al. | 333/33 |
| 4,243,961 A | | 1/1981 | Faillon et al. | 333/233 |
| 4,513,223 A | * | 4/1985 | Chodorow | 315/3 |
| 4,591,799 A | | 5/1986 | Faillon et al. | 330/49 |
| 4,733,131 A | | 3/1988 | Tran et al. | 315/5 |
| 4,749,906 A | | 6/1988 | Tran et al. | 315/5 |
| 4,827,192 A | | 5/1989 | Tran et al. | 315/5.39 |
| 4,933,594 A | | 6/1990 | Faillon et al. | 313/153 |
| 5,043,630 A | | 8/1991 | Faillon et al. | 315/5 |
| 5,109,179 A | | 4/1992 | Faillon et al. | 313/153 |
| 5,225,739 A | | 7/1993 | Faillon et al. | 315/5.43 |
| 5,494,470 A | | 2/1996 | Beunas et al. | 445/35 |
| 5,838,107 A | | 11/1998 | Beunas et al. | 315/5.16 |
| 6,025,678 A | | 2/2000 | Faillon et al. | 315/5 |
| 6,147,447 A | | 11/2000 | Beunas et al. | 313/446 |

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

A multibeam electron tube with several approximately parallel electron beams passing through a body. Among the beams, at least some define an interbeam volume, each beam defining the interbeam volume being subjected to a perturbing azimuthal magnetic field induced by all the other beams. The tube includes an element allowing, in at least one conducting element located in the interbeam volume, flow of a reverse current in the opposite direction to that of the current of the beams, this reverse current generating, in the beams defining the interbeam space, a magnetic correction field whose purpose is to oppose the perturbing magnetic field. Exemplary embodiments of the present invention especially apply to the multibeam klystrons or traveling wave tubes.

20 Claims, 7 Drawing Sheets

SECTION a-a

SECTION a-a

SECTION a-a

MULTIBEAM ELECTRONIC TUBE WITH MAGNETIC FIELD FOR CORRECTING BEAM TRAJECTORY

BACKGROUND OF THE INVENTION

1. Field of the Invention

The present invention relates to multibeam longitudinal-interaction electron tubes such as, for example, klystrons or traveling wave tubes.

2. Discussion of the Background

Klystrons, or traveling wave tubes, generally constructed about an axis, comprise several longitudinal electron beams parallel to this axis. These beams are often produced by a common electron gun, fitted with several cathodes, and are connected at the end of travel in one or more collectors. Between the gun and the collector, the beams pass through a body which is a microwave structure at the output of which microwave energy is extracted. This structure may be formed from a succession of resonant cavities and of drift tubes. The electron beams, in order to maintain their long thin shape, are focused by the magnetic field of a focuser which is centered on the main axis and surrounds the microwave structure.

The advantages of multibeam electron tubes are the following: the current produced is higher and/or the high voltage is lower and/or the length is shorter.

For approximately equal performance, the overall size of the tube is generally smaller. The electrical supply and the modulator used are thus simplified and more compact. The efficiency of interaction is better because of the generally lower perveance of each of the beams.

In the case of klystrons, the bandwidth is increased because of the fact that the cavities are charged by a higher current.

Compared with single-beam tubes, one of the main drawbacks is that it is difficult to generate an optimum magnetic focusing field which allows the beams to travel through the microwave structure without appreciable interception by the drift tubes.

In multibeam klystrons, the intercepted current, called the body current, is often about 4 to 8%, whereas it does not exceed 2 to 3% in conventional single-beam klystrons even when the beam is greatly high-frequency-modulated, as is the case with high-efficiency klystrons.

Excessive interception entails not only prohibitive heating, which requires a complex and expensive cooling system, but also poor operation of the tube since expansion, degassing, frequency changes, oscillations, excitation of spurious modes, reflected electrons, ion bombardment and perturbed interaction between the beam and the microwave structure may occur.

This interception is due to the increase in the space charge forces due to the effect of greater density modulation as one approaches the collector, thereby resulting in an increase in the cross section of the beams which consequently come closer to the walls of the drift tubes. It is also partly due to the focuser which inevitably produces a radial magnetic field in the regions where the axial magnetic field varies, that is to say near the gun and the collector. In addition, since the focuser is never perfect, defocusing parasitic magnetic components are produced.

Another important cause of defocusing specific to multibeam tubes is that each beam creates an azimuthal magnetic field which, depending on the configuration of the tube and its mode of operation, runs the risk of perturbing the other beams. This azimuthal magnetic field results, in the off-axis beams, in a centrifugal radial force which deflects them.

It is known that it is possible, by taking particular care about the configuration of the focuser and of its coil, to reduce the defocusing magnetic components.

It is also possible to contribute to reducing the radial magnetic field by using intermediate pole pieces in the body of the tube.

Improvements may also be made to the gun so that the lines of magnetic flux substantially match the path of the electrons as soon as they are emitted.

It is also possible to vary the inclination of the drift tubes so that they follow the general movement of the beams.

However, all these solutions do not combat the azimuthal magnetic field induced in an off-axis beam by all the other beams.

SUMMARY OF THE INVENTION

The object of the present invention is therefore to reduce, or even cancel, this induced azimuthal magnetic field without degrading the gain or efficiency characteristics.

To achieve this, the present invention proposes a multibeam electron tube comprising several approximately parallel electron beams passing through a body. Among these beams, at least some define an interbeam volume. Each of the beams defining the interbeam volume is subjected to a perturbing azimuthal magnetic field induced by all the other beams. The tube includes, in the body, means allowing, in at least one conducting element located in the interbeam volume, flow of a reverse current in the opposite direction to that of the current of the beams, this reverse current generating, in the beams defining the interbeam volume, a magnetic correction field which opposes the perturbing magnetic field.

The conducting element may be incorporated into the body or, on the contrary, electrically isolated from the body.

The means allowing the reverse current to flow in the conducting element incorporated into the body may comprise a ground connection, close to the input of the body, so that the reverse current comes from the current of the beams which is closed by this ground, the collector being at an intermediate potential between that of the cathodes producing the beams and ground.

Preferably, this ground connection is connected to a high-voltage supply which delivers the potential to the cathodes.

In this type of tube, whether for klystrons or traveling wave tubes, the body comprises a succession of cavities and, at the input and output of the cavities, the beams are contained in drift tubes. When the drift tubes are hollowed out within the same conducting block, this conducting block serves as a conducting element in which the reverse current flows.

To force the flow in the interbeam volume, the conducting block may have, in a central part encompassing the interbeam volume, a lower resistance than that possessed by a peripheral part of the block, located around the central part.

To obtain these various resistances, the central part may be made in a first material and the peripheral part in a second material, the second material having the highest resistance.

It is also recommendable to cut chicanes in the perimeter of the periphery of a block in order to increase the resistance at that point.

When two successive cavities have a common wall integral with a conducting block, a resistive insert may be included in the conducting block and the common wall, this resistive insert forcing the reverse current to flow in the conducting block in a loop around the insert and in the common wall on each side of the insert in opposite directions.

The means allowing the reverse current to flow may comprise a first connection means near the input of the body and a second connection means near the output of the body, these connection means being intended to be connected to a supply that has to deliver the reverse current.

In the configuration in which the conducting element is incorporated into the body, the latter and/or the collector must be electrically isolated from various members with which they are normally in electrical contact.

In the configurations in which the drift tubes are not hollowed out within the same conducting block, the interbeam volume is hollow in the drift tubes and it is possible to house therein the conducting element so as to be approximately parallel to the drift tubes and without any electrical contact with the body.

This conducting element may comprise a rigid section at the input and at the output of a cavity and a flexible connection which struddles a cavity while connecting two rigid sections connected on each side of cavity.

BRIEF DESCRIPTION OF THE DRAWINGS

Further features and advantages of the invention will appear on reading the description of illustrative examples of multibeam tubes according to the invention, this description being given in conjunction with the appended figures which show.

DESCRIPTION OF THE PREFERRED EMBODIMENTS

Figure 1B:
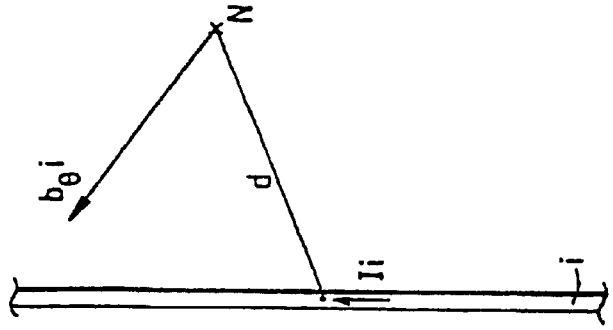
FIG. 1*b,* the magnetic field induced by an electron beam.
Figure 1A:
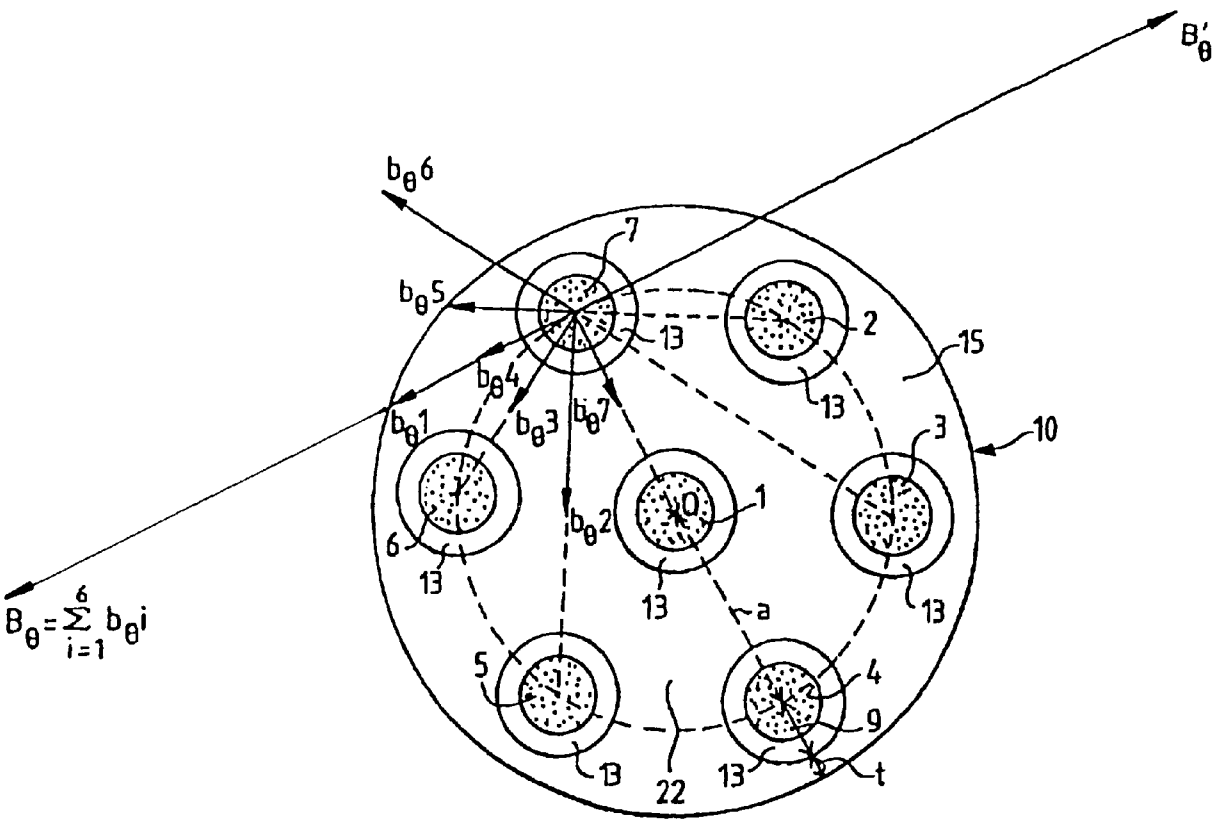
FIG. 1*a,* in cross section, the body of a multibeam tube according to the invention.

FIG. 1*a* shows, in cross section, the electron beams 1–7 of a multibeam tube. These approximately parallel beams are each contained in a drift tube 13 within the body. These drift tubes 13 are hollowed out in the same conducting block 15 which forms part of the body 10 of the tube. One of these beams 1 is centered on a central axis, perpendicular to the sheet, passing through the point 0. The other beams 2 to 7, arranged on a circle centered on 0, are off-axis. Conventionally, they are approximately equidistant from one another.

Referring to FIG. 1*b,* a beam i of current Ii creates, at a point N a distance d from the axis of the beam, in a plane perpendicular to the beam i, a magnetic field $b_\theta i$ approximately equal to:

$$b_\theta i = \mu_0 Ii/2\pi d$$

where $\mu_0$ is the magnetic permeability of the medium.

At least one off-axis beam 7 of the tube in FIG. 1*a* is therefore subjected, on the one hand, to its own field $b_\theta$7 which generates a nondeflecting centripetal focusing force and, on the other hand, to the resultant $B_\theta$ of the fields $b_\theta$1, $b_\theta$2, $b_\theta$3, $b_\theta$4, $b_\theta$5 and $b_\theta$6 induced by all the other beams 1 to 6, i.e.

$$\vec{B}_\theta = \vec{b}_\theta 1 + \vec{b}_\theta 2 + \vec{b}_\theta 3 + \vec{b}_\theta 4 + \vec{b}_\theta 5 + \vec{b}_\theta 6$$

This resultant field $B_\theta$generates a centrifugal radial force which deflects the beam 7 away from the central axis. With regard to the central beam 1, if there is one, this is not deflected for symmetry reasons.

Figure 2:
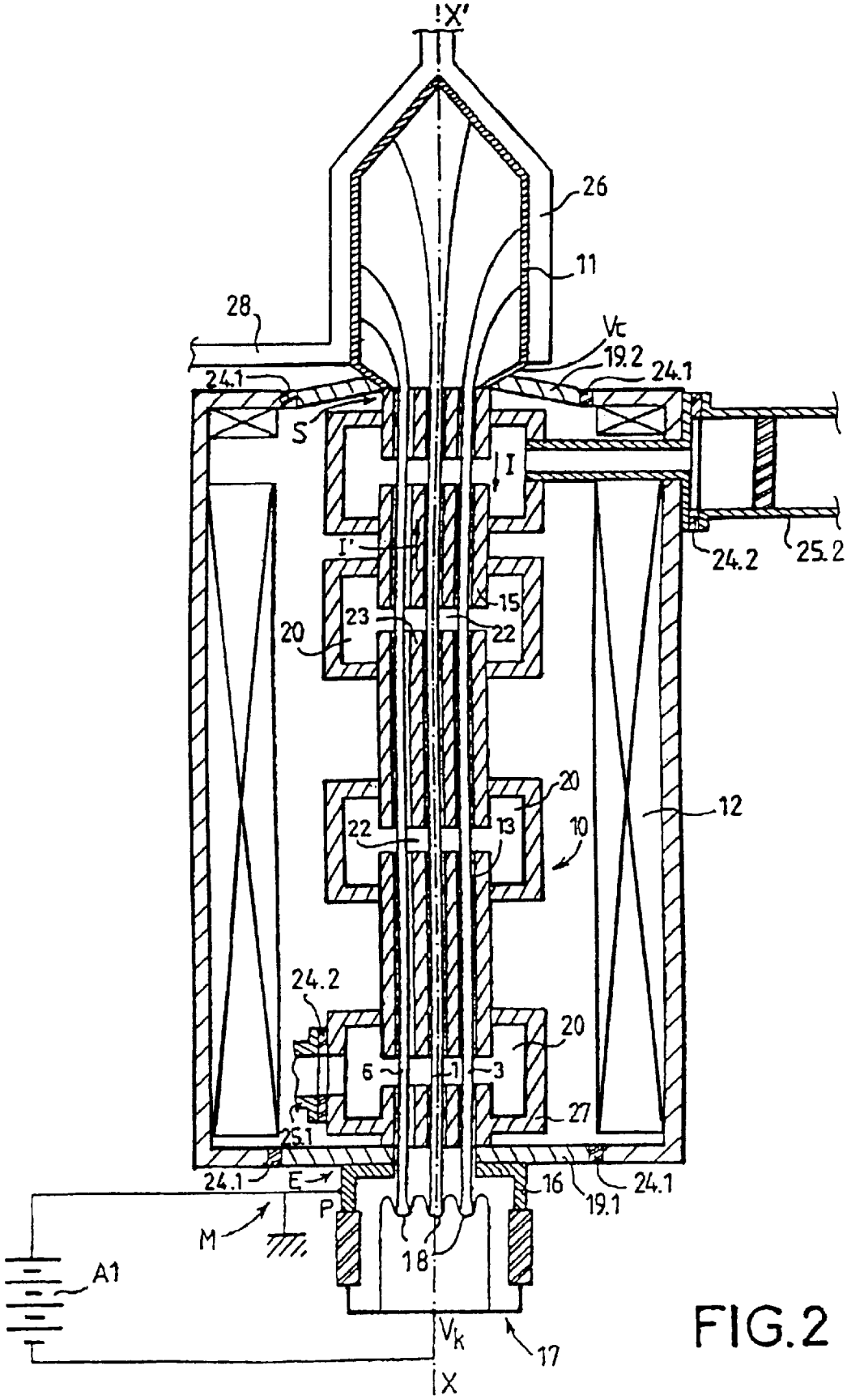
FIG. 2, a longitudinal section of a multibeam klystron according to the invention.

Reference is now made to FIG. 2 which shows a multibeam tube according to the invention. This tube is a multibeam klystron. It is constructed about an axis XX'.

The tube is assumed to have several beams numbered 1 to 7, arranged like those in FIG. 1*a* to which reference will also be made. Among these seven beams, six, labeled 2 to 7, define an interbeam volume 22. In the example, they are placed on a circle of radius a and the interbeam volume 22 is cylindrical. The last beam 1 is centered on the axis XX', the other beams being off-axis. The beams 1 to 7 are produced by a gun 17. They then enter a body 10, through which they pass, and are collected at its output S in a collector 11. The gun 17 has seven cathodes 18 which produce the beams 1 to 7 when they are at an appropriate potential $V_K$ delivered by a high-voltage supply A1. It also includes an anode 16 which accelerates the electrons toward the input E of the body 10. The anode is at a less negative potential than the potential $V_K$ of the cathodes. In FIG. 2, only three cathodes are visible.

The body 10 is formed from an alternation of cavities 20 and of drift tubes 13. The cavities 20 have side walls 27. The beams 1 to 7 are contained in the drift tubes 13 before penetrating the first cavity 20, on leaving the last cavity 20 and more generally between each cavity 20. The body 10 is placed in a tubular focuser 12. The body 10 starts after an input pole piece 19.1 and terminates before an output pole piece 19.2.

Each of the beams 2 to 7 defining the interbeam volume 22 is subjected to a defocusing azimuthal magnetic field which deflects it. This azimuthal magnetic field is induced by all the other fields, as has just been described in FIG. 1. In order to try to attenuate, or even cancel out, the effects of this induced azimuthal magnetic field, the multibeam electron tube according to the invention includes, within the body 10, means M allowing, in at least one conducting element 23 located in the interbeam volume 22, flow of a reverse current I' in the opposite direction to the current I carried by all the beams. This reverse current I' generates, within the perturbed beams 2 to 7, an azimuthal magnetic correction field $B'_\theta$ which tends to oppose the induced azimuthal magnetic field $B_\theta$.

In the example in FIG. 2, the conducting element 23 is incorporated into the body 10 of the tube and the means M allowing flow of the reverse current I' comprise a ground connection P, near the input E of the body 10, so that the reverse current I' comes from the current I carried by all the beams which is closed by this ground. The collector 11 is, of course, at an intermediate potential $V_C$ between $V_K$ of the cathodes 18 and ground.

Placed at the input and output of the cavities 20 are conducting blocks 15 within which are hollowed out as many drift tubes 13 as there are beams 1–7, as described in FIG. 1*a*.

These conducting blocks 15 form the conducting element 23 inside which the reverse current I' flows. In FIG. 1*a,* the conducting block 15 shown is a cylinder of radius a+g+t, where g is the radius of a drift tube and t is the thickness of material located between the drift tubes 13 and the edge of the block 15. This thickness t contributes to sealing the inside of the body 10.

In the configuration shown in FIG. 2, the reverse current I' flows within the entire body 10, in the reverse direction to the current I of the beams 1–7, but only the part which flows inside the interbeam space 22 provides a correction. The part flowing on the outside of the interbeam volume 22, especially in the side walls 27 of the cavities, does not participate in the correction, but does not induce any perturbation.

In the example in FIG. 2, the ground connection P is located at the anode 16 of the gun 17. It is conceivable to put the ground connection at the input pole piece 19.1. This input pole piece 19.1 prevents the cathodes 18 from being perturbed by the magnetic field of the focuser 12.

In this configuration, the potential $V_K$ of the cathodes 18 is delivered by the supply A1 which is connected between the cathodes 18 and the ground connection P.

Conventionally, in this kind of tube, a ground connection was made at the collector 11 or, if it was electrically isolated from the body 10, at the output pole piece 19.2 which prevents the electrons collected in the collector 11 from being perturbed by the magnetic field of the focuser 12.

The fact of making the reverse current I' flow in a conducting element 23 incorporated into the body 10 of the tube now requires this body 10 and/or the collector 11 to be electrically isolated with respect to other components of the tube with which they were in electrical contact in the conventional configurations of the prior art. In particular, the focuser 12 will be electrically isolated from the body 10 using a dielectric material 24.1. In the example, the isolation is accomplished by means of input and output pole pieces 19.1, 19.2. These pole pieces 19.1, 19.2 are, in conventional tubes, in contact with the body at its input E and at its output S. For example, a PTFE sheet 24.1 inserted between the focuser 12 and the pole pieces 19.1, 19.2 will be used. There are also transmission guides located within the extreme cavities 20. An input waveguide 25.1 is connected to the first cavity 20 and it makes it possible to inject into the latter a signal to be amplified. This waveguide 25.1 is electrically isolated from the body 10 by means of an isolating collar 24.2. The last cavity 20 communicates with an output waveguide 25.2 intended for the transmission of the microwave energy produced by the tube to a user device (not shown). This waveguide 25.2 is electrically isolated from the body 10 by means of an insulating collar 24.2.

In general, a cooling device 26 is provided around the collector 11 and even possibly around the body 10. This cooling device 26 will be electrically isolated from the collector 11 and if necessary from the body 10. This isolation may be obtained by making the cooling device from dielectric materials, for example at least one plastic duct 28 through which a resistant coolant flows. As coolant, deionized water may be used.

Calculations show that the reverse current I' providing an exact compensation is such that I'=½I, where I corresponds to the total current of all the beams 1 to 7 of the tube.

The azimuthal magnetic field induced in one of the beams defining the interbeam space 22 by the other beams is given by:

$B_\theta=\mu_0 I/4\pi a$ if the beams defining the interbeam space are arranged on a circle of radius a.

If the total current I of the beams 1 to 7 is made to flow in the conducting block 15, having a cross section of radius a+g+t, the reverse current I' is given by:

$$I' \approx Ia^2/(a+g+t)^2$$

and this reverse current I' clearly allows exact compensation if the values of a, g and t are such that the ratio $a^2/(a+g+t)^2$ is equal to 0.5.

Quantities such that a=21.8 mm, g=6 mm and t=3 mm allow the optimum result to be obtained.

The dimensions a, g, t are illustrated in FIG. 1*a,* but are not shown to scale.

One way allowing an optimum reverse current I' to be obtained from current flow through the entire body 10 is to force the current to pass preferentially through the interbeam volume.

Figure 3A:
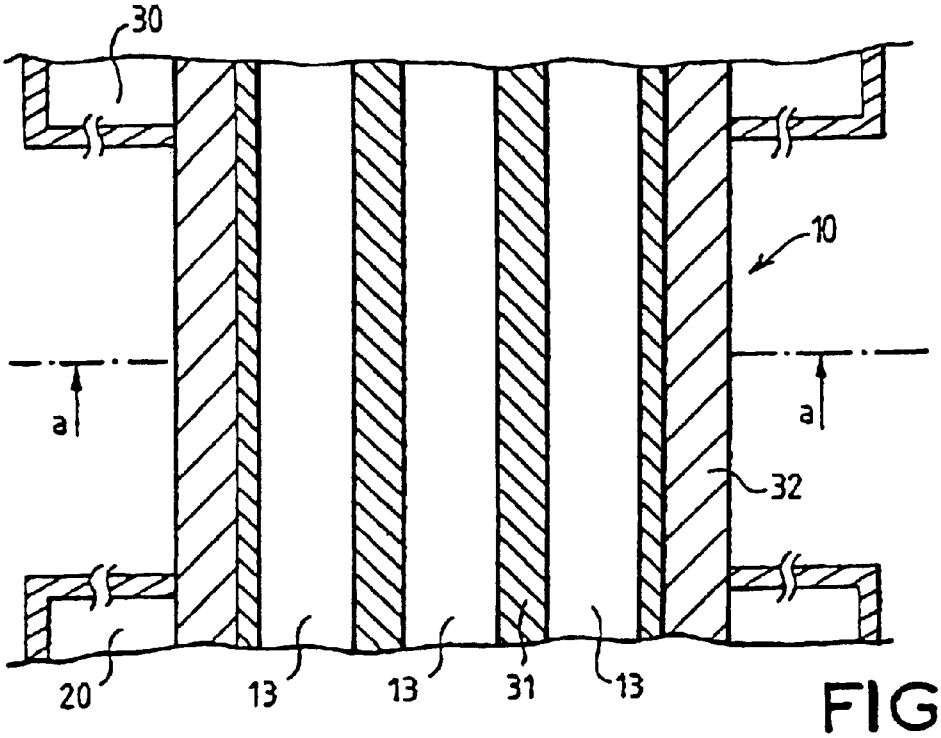
FIGS. 3*a,* 3*b,* partial longitudinal and cross sections of the body of a klystron according to the invention with a conducting element incorporated into the body.

FIGS. 3*a,* 3*b,* 4*a,* 4*b* show, in longitudinal and cross section, one portion of the body 10 of a multibeam klystron according to the invention, in which two different ways of favoring the current flow in the interbeam volume are given.

Figure 3B:
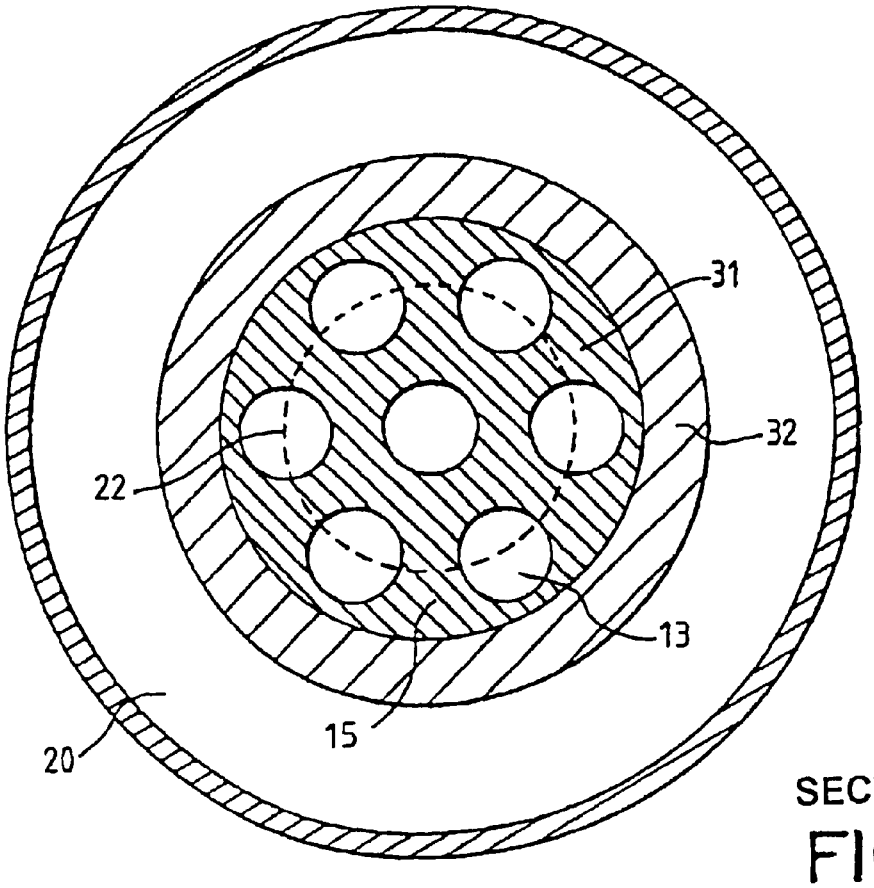

Two successive cavities 20 are shown schematically in FIG. 3*a*. They have not been shown in FIG. 4*a* in order to simplify matters. The cross sections in FIGS. 3*b,* 4*b* are taken on the plane of section aa.

In FIGS. 3*a,* 3*b,* the conducting blocks 15 are formed from a central part 31 surrounded by a peripheral part 32. The drift tubes 13 are located in the central part 31. The boundary of the interbeam volume 22 corresponds approximately to the circle, shown as a dotted line in FIG. 3*b,* passing through the center of the drift tubes 13 and the central part 31 surrounds the interbeam volume 22.

By making, for at least one of the blocks, the central part 31 in a first material and the peripheral part 32 in a second material and by choosing these materials so that the resistivity of the first material is lower than that of the second material, this preferential flow through the interbeam volume 22 is clearly obtained.

The central part 31 may, for example, be based on copper and the peripheral part based on stainless steel. Other choices are possible. The choice of the material of the peripheral part 32 must be compatible with the desired sealing.

Figure 4A:
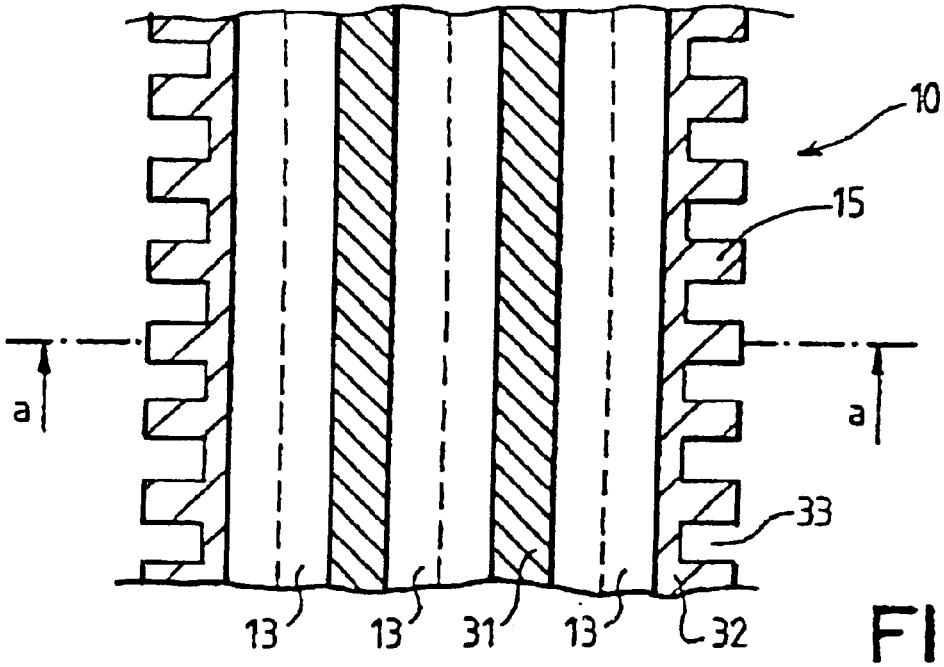
FIGS. 4*a,* 4*b,* partial longitudinal and cross sections of another embodiment of a klystron according to the invention with a conducting element incorporated into the body.
Figure 4B:
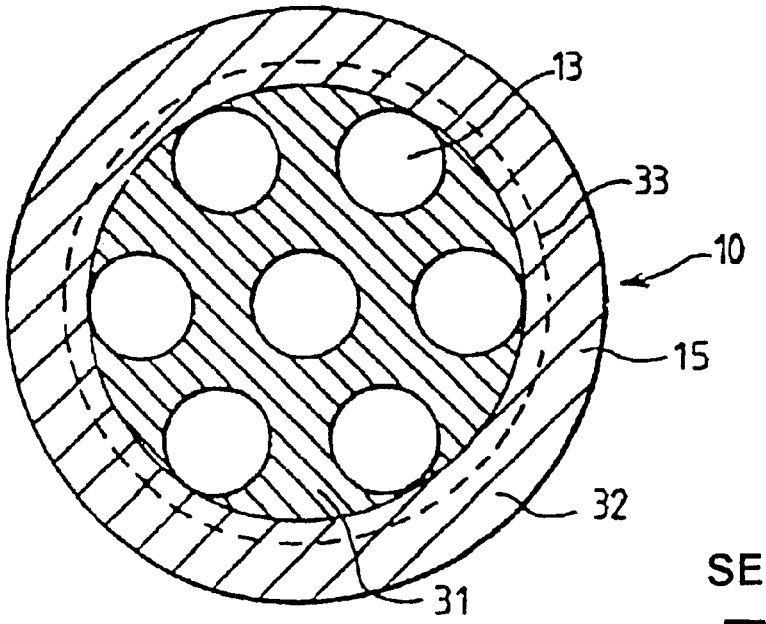

Another way of increasing the resistivity at the periphery of at least one block 15 with respect to that in the interbeam volume is to cut chicanes 33 in the periphery of the block 15. These chicanes 33 are illustrated in FIGS. 4*a,* 4*b*. This configuration with chicanes may be combined with that described in FIGS. 3*a,* 3*b,* as FIG. 4 show, but this is not necessary.

Figure 6:
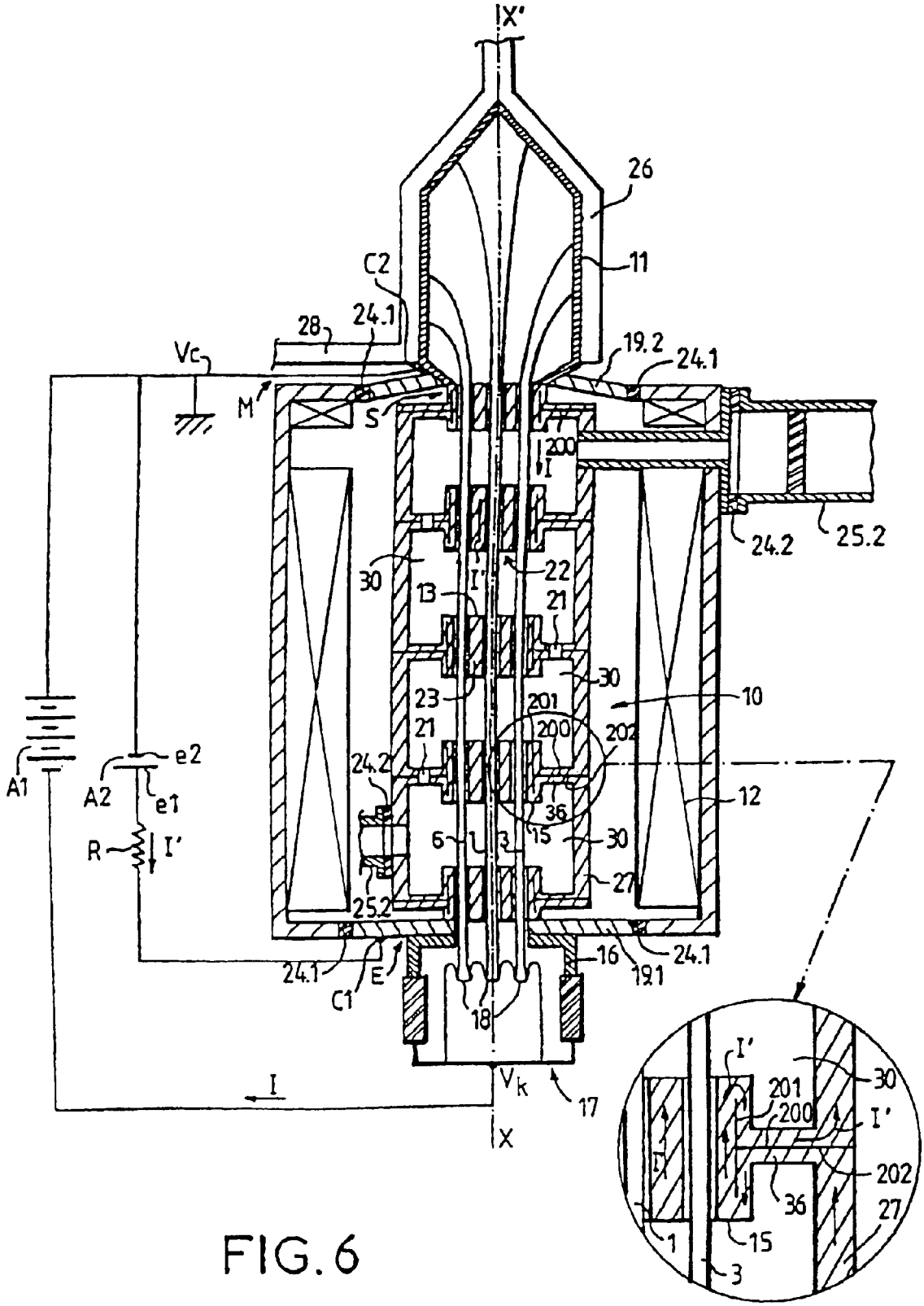
FIG. 6, a longitudinal section of a multibeam traveling wave tube according to the invention.

Instead of the reverse current I' coming from the beam current I, it is possible for the means M allowing flow of the reverse current I' to include two connection means C1, C2, one close to the input E of the body 10 and the other close to its output S, these connection means being intended to be connected to the terminals of a low-voltage supply A2 which has to deliver the reverse current I'. FIG. 6 (described later) shows this feature applied to a multibeam traveling wave tube. Of course, it can be applied to multibeam klystrons.

In the multibeam klystrons described, compensation of the path of the beams occurs at the point where the reverse current flows within the interbeam volume, that is to say within the drift tubes 13. However, these drift tubes 13 occupy approximately 75% of the length of the body 10, which means that only 25% of the length of the beams does not receive a correction, but this is not a problem. A suitable correction at the input and at the output of the cavities 20 may, if necessary, be envisioned in order to reduce this undesirable defocusing effect.

In the configurations in which the drift tubes 13 are not hollowed out within the same conducting block 15 but are produced by tubes 13 connected to the cavities 30 and separated from one another, the interbeam volume 22 is not full of conducting material.

Figure 5A:
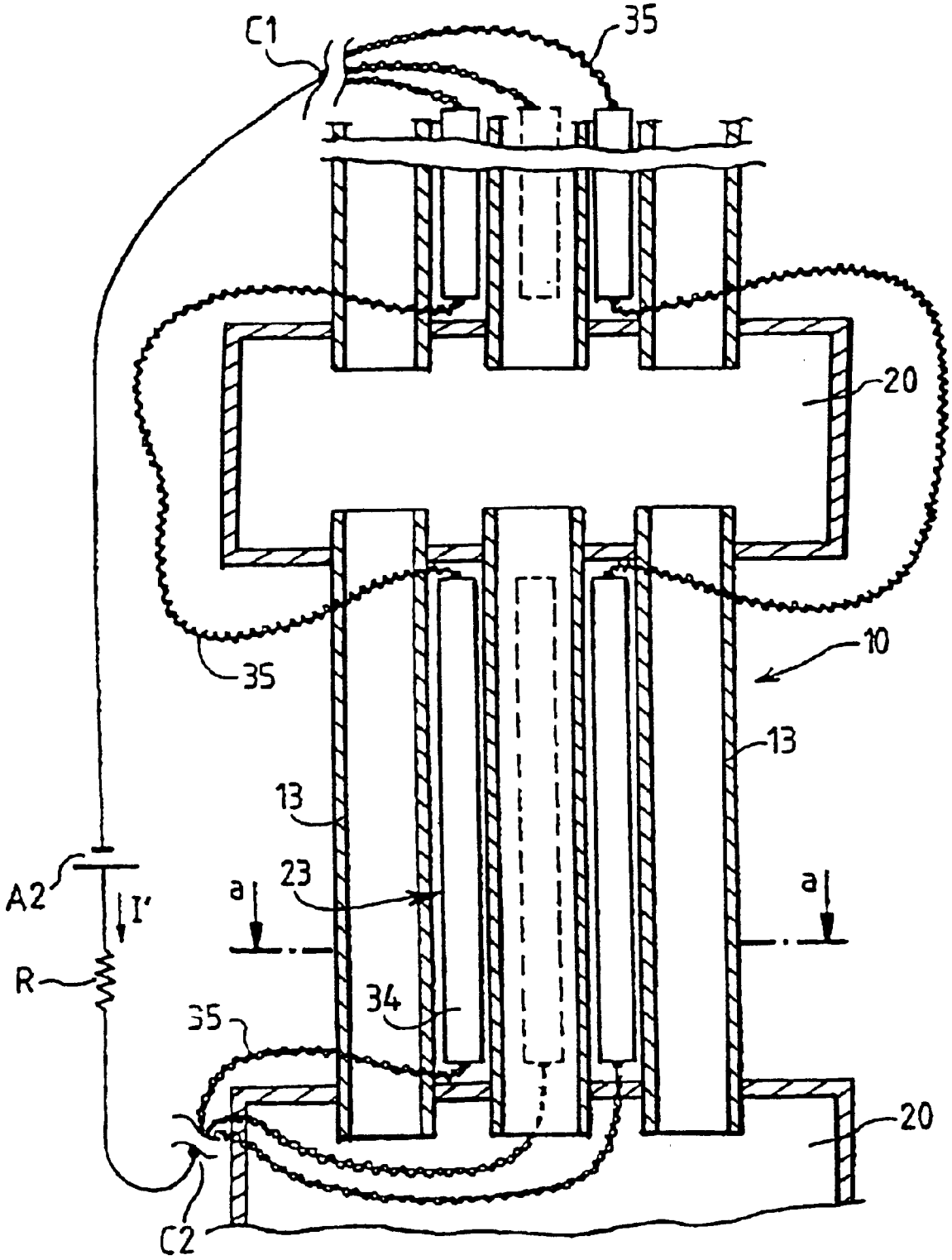
FIGS. 5*a,* 5*b,* 5*c,* partial longitudinal and cross sections of the klystron body according to the invention with conducting elements isolated from the body.

FIGS. 5*a,* 5*b* show, in partial longitudinal and cross sections, a multibeam klystron body with this feature.

In this case, the conducting element 23 through which the reverse current I' flows is electrically isolated and separate from the body 10. It extends in the interbeam volume 22, parallel to the drift tubes 13, without any electrical contact with them or with the cavities 20. It may be formed from rigid conducting sections 34 located at the input and output of the cavities, these sections being able to be rigid conducting rods sheathed with an insulation 37, such as alumina.

Over the entire length of the body, there will be a succession of rigid conducting sections 34, two rigid conducting sections 34 located on each side of a cavity 20 being connected by a flexible connection 35 which straddles the cavity 20. A flexible connection 35 may be a metal braid sheathed with an insulation.

The means M allowing the reverse current I' to flow comprise, at the two ends of the conducting element 23, connection means C1, C2 intended to be connected to a supply A2 which has to deliver the reverse current I'.

Figure 5B:
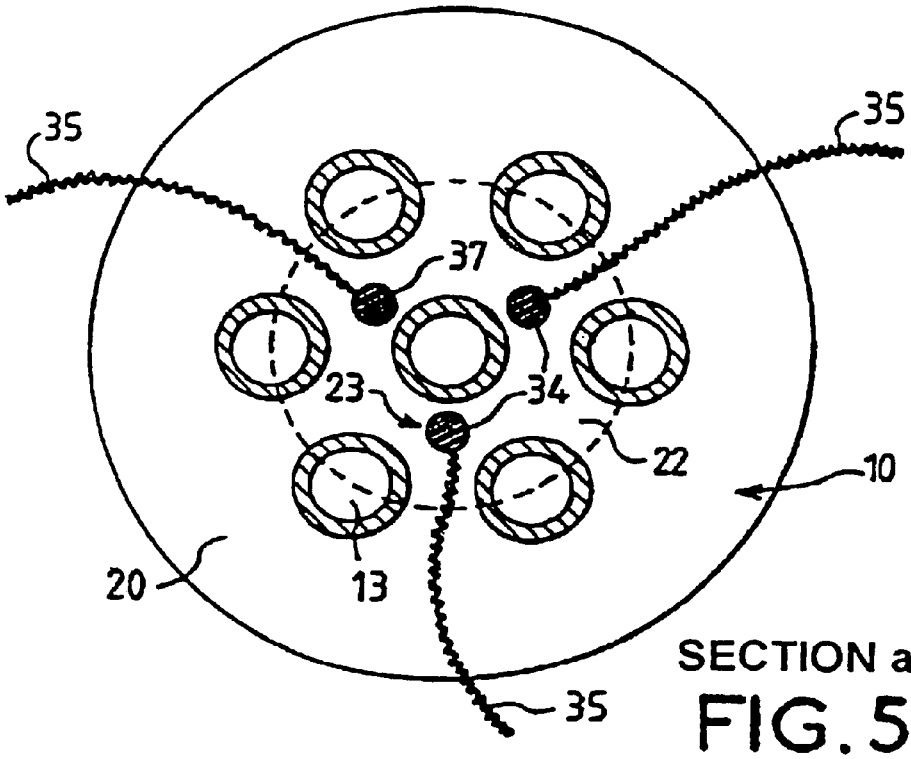
Figure 5C:
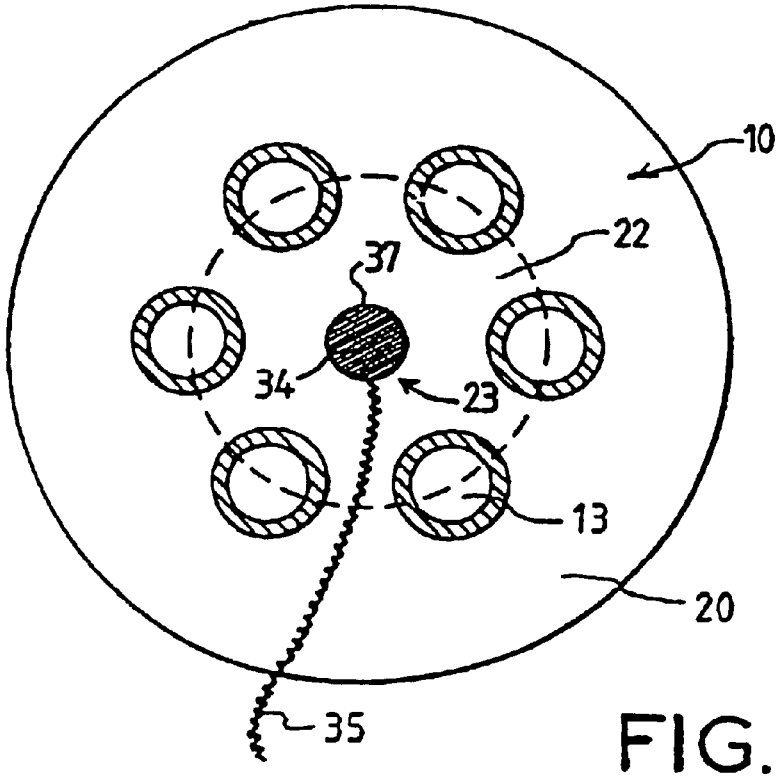

If the tube does not have a central beam, as illustrated in FIG. 5*c,* a single conducting element 23 is sufficient at the center; if the tube has a central beam, as illustrated in FIG. 5*b,* several conducting elements 23 are desirable, these being arranged between the central beam 1 and the beams 2–7 defining the interbeam volume 22.

The undesirable magnetic field induced in one of the beams by the others appears in the tube only when it operates in the steady state or with relatively long pulse durations. This is the case in many tubes used in telecommunications applications, in industrial or scientific applications, and even in radar.

This is because each time the beams are injected into the body 10, they induce, for a certain time, in the drift tubes, eddy currents which oppose the perturbing induced magnetic field.

Calling F the pulse repetition frequency of the tube, the thickness e of the material through which the perturbing induced magnetic field can pass is given by:

$$e = \frac{1}{2\pi}\sqrt{\frac{10^9\rho}{F\mu_r}}$$

where ρ is the resistivity of the material in Ω·cm and $\mu_r$ is the relative permeability of the material. For copper, ρ is $1.72\times10^{-6}$ Ω·cm and $\mu_r$ is 1.

If the tube has six beams in a ring, separated by a copper thickness e of 16 millimeters, the pulse repetition frequency F is at most 17 Hz, which amounts to saying that the pulses can last only 30 to 40 ms without a defocusing effect.

The transmission problems in multibeam klystrons are all the greater the higher the power and the longer the pulses.

The tubes that have just been described are klystrons. A multibeam tube according to the invention could also be of the traveling wave tube type as illustrated in FIG. 6.

In this type of tube, the body 10 is formed from a succession of cavities 30 coupled to one another by irises 21 placed on a common wall 36. The beams 1 to 7 are contained in drift tubes 13 before penetrating the first cavity 30, on leaving the last cavity 30 and, more generally, between the cavities 30. But now the drift tubes 13 occupy less than 50% of the length of the body 10, which means that the correction obtained is less efficient, but nevertheless remains advantageous. The conducting blocks in which the drift tubes 13 are hollowed out bear the reference 15 and the common walls 36 are integral with the conducting blocks 15.

To favor flow of the reverse current I' in the interbeam volume 22 over the longest possible length, it is possible to include, in the conducting blocks 15 and in the common walls 36, resistive inserts 200 that the reverse current I' will go around. These inserts 200 are shown in FIG. 6 as two parts 201, 202 fastened to each other. The first part 201 placed in the conducting blocks 15 has the shape of a tubular element which surrounds the drift tubes 13. The reverse current I' flows in the conducting block 15 as a loop around the first part 201.

The second part 202 extends from the first part 201 in the thickness of the common wall 36, like a flange.

The reverse current I' flows in the common wall 36 on each side of the second part 202 in opposite directions.

By making a radial cross section of a block 15, an insert 200 has the shape of a T, the leg of which is the second part 202 and the cross bar of which is the first part 201. The flow of the reverse current I', which goes around the insert 200, is shown in the encircled detail in FIG. 6.

These inserts 200 may be made, for example, of stainless steel, of alumina or even of recesses.

The means M allowing flow of the reverse current I' now comprise two connection means C1, C2, one near the input E of the body 10 and the other C2 near the output S of the body, these connection means C1, C2 being intended to be connected to the terminals e1, e2 of a low-voltage supply A2 which has to deliver the reverse current I'. In FIG. 6, the first connection means C1 is at the input pole piece 19.1 and the second connection means C2 is at the base of the collector 11. The first connection means C1 could be on the anode 16 and the second on the output pole piece. In the example described, the second connection means C2 is at ground potential, but other potentials would be conceivable.

A suitably chosen resistor R in series with the low-voltage supply A2 allows the value of the reverse current to be adjusted.

In FIG. 6, another supply A1 is shown conventionally. It is connected between the cathodes 18 and the collector 11 and serves to create the beams 1 to 7. This is a high-voltage supply.

The multibeam tubes according to the invention do not have a modified structure compared with the existing tubes and all that is required is to provide the connections described.

What is claimed is:

1. A multibeam electron tube comprising several approximately parallel electron beams (1–7) passing through a body, among the beams, at least some defining an interbeam volume, each beam defining the interbeam volume being subjected to a perturbing azimuthal magnetic field induced by all the other beams, characterized in that it includes means for allowing, in at least one conducting element located in the interbeam volume, flow of a reverse current in the opposite direction to that of the current of the beams, this reverse current generating, in the beams defining the interbeam space, a magnetic correction field whose purpose is to oppose the perturbing magnetic field.

2. The multibeam electron tube as claimed in claim 1, characterized in that the conducting element is incorporated into the body of the tube.

3. The electron tube as claimed in claim 2, in which the beams are collected in a collector and which comprises one or more devices which interact with the body and/or the collector, characterized in that these devices are electrically isolated from the body and/or from the collector.

4. The electron tube as claimed in claim 3, characterized in that it includes, as a device electrically isolated from the body and/or from the collector, a cooling device surrounding the body and/or the collector, formed from at least one duct made of insulating material through which duct a resistant fluid flows.

5. The electron tube as claimed in claim 3, characterized in that it includes, as a device electrically isolated from the body, a tubular focuser in which the body is placed, a dielectric element being placed at the input and at the output of the body in order to isolate it from the focuser.

6. The electron tube as claimed in claim 3, characterized in that it includes, as a device electrically isolated from the body, at least one transmission guide isolated by a dielectric collar from the body.

7. The multibeam electron tube as claimed in claim 1, comprising a gun with one or more cathodes which emit the electrons of the beams, these beams passing through the body from an input toward an output where they are collected by at least one collector, characterized in that the means allowing the reverse current to flow comprise a ground connection close to the input of the body so that the reverse current comes from the current of the beams which is closed by this ground, the collector being at an intermediate potential between ground and the voltage of the cathodes.

8. The electron tube as claimed in claim 7, characterized in that the ground connection is located at an anode with which the gun is provided.

9. The electron tube as claimed in claim 7, characterized in that the ground connection is at an input pole piece located at the input of the body.

10. The electron tube as claimed in claim 7, characterized in that the ground connection is intended to be connected to a supply which delivers the potential to the cathodes.

11. The electron tube as claimed in claim 1, characterized in that the means allowing the reverse current to flow comprise a first connection means close to the input of the body and a second connection means close to the output of the body, these connection means being intended to be connected to a supply which has to deliver the reverse current.

12. The electron tube as claimed in claim 1, characterized in that the body comprises a succession of cavities, the beams being contained at the input and at the output of the cavities in drift tubes hollowed out within a conducting block, the conducting block serving as a conducting element.

13. The electron tube as claimed in claim 12, characterized in that at least one conducting block has a resistance, in a central part enclosing the interbeam volume, less than that which it has in a peripheral part surrounding the central part.

14. The electron tube as claimed in claim 13, characterized in that the central part is made in a first material and the peripheral part in a second material, the first material having a lower resistivity than that of the second material.

15. The electron tube as claimed in claim 12, characterized in that the periphery of at least one block has chicanes around its perimeter so as to increase its peripheral resistivity.

16. The electron tube as claimed in claim 12, characterized in that two successive cavities have a common wall which bears on a conducting block, the conducting block and the common wall including a resistive insert which forces the reverse current to flow in the conducting block as a loop around the insert and in the common wall, on each side of the insert in opposite directions.

17. The electron tube as claimed in claim 1, the body of which comprises a succession of cavities and in which the beams are contained, at the input and at the output of the cavities, in drift tubes, separated from each other, characterized in that the conducting element is longitudinal and extends in the interbeam volume parallel to the drift tubes, without any electrical contact either with the drift tubes or with the cavities.

18. The electron tube as claimed in claim 17, characterized in that the conducting element comprises a rigid conducting section at the input and at the output of a cavity, two successive sections on each side of the cavity being connected by a flexible connection straddling the cavity.

19. The electron tube as claimed in claim 17, characterized in that the conducting element is sheathed with an insulation.

20. The electron tube as claimed in claim 17, characterized in that the means allowing the reverse current to flow comprise, at each end of the conducting element, connection means for connecting them to the terminals of a supply which has to deliver the reverse current.

* * * * *